US005735069A

United States Patent [19]

Gearing

[11] Patent Number: 5,735,069

[45] Date of Patent: Apr. 7, 1998

[54] FRAME ASSEMBLY

[75] Inventor: Robert Edwin Gearing, Cape Town, South Africa

[73] Assignee: Rob Gearing & Associates (Proprietary) Ltd., Cape Town, South Africa

[21] Appl. No.: 514,408

[22] Filed: Aug. 11, 1995

[30] Foreign Application Priority Data

Aug. 12, 1994 [ZA] South Africa ..... 94/6091

[51] Int. Cl.[6] ..... G09F 1/12

[52] U.S. Cl. ..... 40/793; 40/782; 40/611

[58] Field of Search ..... 40/790, 791, 792, 40/793, 611, 782

[56] References Cited

U.S. PATENT DOCUMENTS

| | | | |
|---|---|---|---|
| 2,941,324 | 6/1960 | Waxgiser . | |
| 2,979,842 | 4/1961 | Ridder . | |
| 3,034,612 | 5/1962 | Jourdan | 40/782 X |
| 3,132,432 | 5/1964 | Yee | 40/730 |
| 3,386,198 | 6/1968 | Howell . | |
| 3,447,274 | 6/1969 | Davidson | 40/730 X |
| 3,648,393 | 3/1972 | Parrilla | 40/730 |
| 3,885,335 | 5/1975 | Egermayer . | |
| 3,899,844 | 8/1975 | Munn . | |
| 4,237,632 | 12/1980 | Segerstad . | |
| 4,356,648 | 11/1982 | Beaulieu . | |
| 4,498,255 | 2/1985 | Heard . | |
| 4,516,342 | 5/1985 | Reim . | |
| 4,676,686 | 6/1987 | Eisenloffel | 40/782 X |
| 4,974,351 | 12/1990 | Ghislanzoni . | |
| 5,187,886 | 2/1993 | Wu et al. | 40/782 X |
| 5,199,201 | 4/1993 | Vilims . | |
| 5,307,575 | 5/1994 | Ivansson et al. . | |

FOREIGN PATENT DOCUMENTS

| | | |
|---|---|---|
| 33751 | 4/1971 | Canada . |
| 67799 | 3/1990 | Canada . |

*Primary Examiner*—Brian K. Green
*Assistant Examiner*—Andrea Chop
*Attorney, Agent, or Firm*—James Ray & Associates

[57] ABSTRACT

A frame assembly has a backing board and elongate frame members positioned end-to-end around the periphery of the backing board. Each frame number has an edge member, with a pair of limbs positioned on opposite sides of the edge of the backing board, and clamp elements. Each clamp element has a formation which urges the limbs apart to induce a stress in the edge member which, in turn, urges the clamp elements towards the backing board. The formations of the clamp elements and the complementary edge portions of the edge member define retaining formations which retain the clamp elements captive between the edge member and the board and permit pivotal displacement of the clamp elements. The clamp elements have gripping formations configured to facilitate displacement of the clamp elements from their closed positions towards their open positions.

14 Claims, 5 Drawing Sheets

FRAME ASSEMBLY

THIS INVENTION relates to frames. More particularly it relates to a frame assembly and to a frame assembly kit. It also relates to a display holder and to a display holder kit.

According to one aspect of the invention there is provided a frame assembly which includes a backing board; and a plurality of elongate frame members positioned end-to-end around at least part of the periphery of the backing board each frame member including an edge member having a pair of limbs positioned on opposite sides of an edge portion of the backing board; and at least one clamp element having a first edge portion which is positioned between a complementary edge portion of one of the limbs of the edge member and the backing board and which urges the limbs of the edge member apart to induce a stress in the edge member which in turn urges the clamp element towards the backing board, the first edge portion of the clamp element and the complementary edge portion of the edge member defining complementary retaining formations which serve to retain the first edge portion of the clamp element captive between the complementary edge portion of the edge member and the backing board and which permit displacement of the clamp element between a closed position, in which an edge portion of a sheet can be clamped between the clamp element and the backing board, and an open position, in which an edge portion of a said sheet can be positioned or removed from between the clamp element and the backing board, the clamp element having at least one gripping formation spaced from its first edge portion and configured to facilitate displacement of the clamp element from its closed position towards its open position.

The gripping formation may be in the form of a lip at that edge of the clamp element remote from the edge member, the lip being clear of the backing board even when the complementary element is in its closed position.

According to another aspect of the invention there is provided a frame assembly which includes a backing board;

a plurality of elongate frame members positioned end-to-end around at least part of the periphery of the backing board, each frame member including an edge member having a pair of limbs positioned on opposite sides of an edge portion of the backing board; and at least one clamp element having a first edge portion which is positioned between a complementary edge portion of one of the limbs of the edge member and the backing board and which urges the limbs of the edge member apart to induce a stress in the edge member which in turn urges the clamp element towards the backing board, the first edge portion of the clamp element and the complementary edge portion of the edge member defining complementary retaining formations which serve to retain the first edge portion of the clamp element captive between the complementary edge portion of the edge member and the backing board and which permit displacement of the clamp element between a closed position in which an edge portion of a sheet can be clamped between the clamp element and the backing board and an open position in which an edge portion of a said sheet can be positioned or removed from between the clamp element and the backing board; and a fastener connecting each pair of adjacent edge members together, the fastener having a pair of elongate limbs connected together at their one ends, the limbs being located in the edge members of adjacent frame members to retain the adjacent frame members in position relative to one another.

The fastener and the adjacent edge members may have complementary retaining formations for retaining the limbs of the fasteners in position in the edge members.

The retaining formations of each edge member may define a limb receiving zone within which the limb of the associated fastener is snugly received, the complementary retaining formation of the associated fastener including at least one protrusion standing proud of the limb and abutting a surface of the edge member defining the limb receiving zone.

Each protrusion may be inclined relative to the surface of the associated limb such that the extent to which it protrudes increases away from the free or leading end of the limb thereby facilitating the introduction of the limb into the limb receiving zone and resisting withdrawal of the limb from the limb receiving zone.

The complementary retaining formations of the clamp element and edge member may together define a cam arrangement configured such that, displacement of the clamp element from its closed position to its open position or vice versa, initially urges the limbs of the edge member further apart and then permits the spacing between the limbs to decrease so that the cam arrangement operates in the manner of an over-centre mechanism.

At least one of the edge members and clamp elements may be formed as extrusions. The clamp element may thus be extruded, e.g. of aluminium or a synthetic plastics material. Similarly, the edge member may be extruded, e.g. of aluminium or a synthetic plastics material. Preferably, both the clamp element and the edge members will be of extruded construction.

Each frame member may include two clamp elements which are positioned between the limbs of the associated edge member and opposite sides of the backing board. This arrangement permits posters, paintings or the like to be mounted on both sides of a backing member such as a backing board.

According to still another aspect of the invention there is provided a display holder which includes at least two frame assemblies; and connecting means whereby the frame assemblies are connected together.

Each frame assembly may include at least one elongate frame member extending along at least part of the periphery of a backing board, the connecting means including a connector connected to, and extending between, adjacent frame members to connect together adjacent frame assemblies, of which the adjacent frame members form part.

The connector may include a pair of frame member engaging formations which are connected together and which engage with complementary formations on the adjacent frame members.

The complementary formations on each of the adjacent frame members may include a pair of oppositely disposed outwardly open longitudinally extending recesses and each frame member engaging formation may include a pair of oppositely inwardly disposed lips which are slidably receivable in the recesses.

The frame member engaging formations may be connected together by means of a bridging-piece configured to permit displacement of the frame member engaging formations relative to one another. The bridging-piece may be in the form of a strip of an elastomeric material such as monoprene rubber.

At least one of the frame assemblies may be a frame assembly as described above.

According to yet another aspect of the invention there is provided a frame assembly kit which includes at least one frame member which is mountable on a backing board to form at least part of a frame assembly as described above.

The kit may include at least two frame members or means for forming at least two frame members and a fastener for connecting the frame members together.

According to still yet another aspect of the invention there is provided a display holder kit which includes frame forming means for forming at least part of at least two frame assemblies; and connecting means whereby the frame assemblies are connectable together.

The frame forming means may include a plurality of frame members, the connecting means including a connector having a pair of frame member engaging formations which are connected together and are configured to engage with complementary formations on the frame members.

The invention will now be described, by way of example, with reference to the accompanying diagrammatic drawings.

In the drawings.

Figure 1:
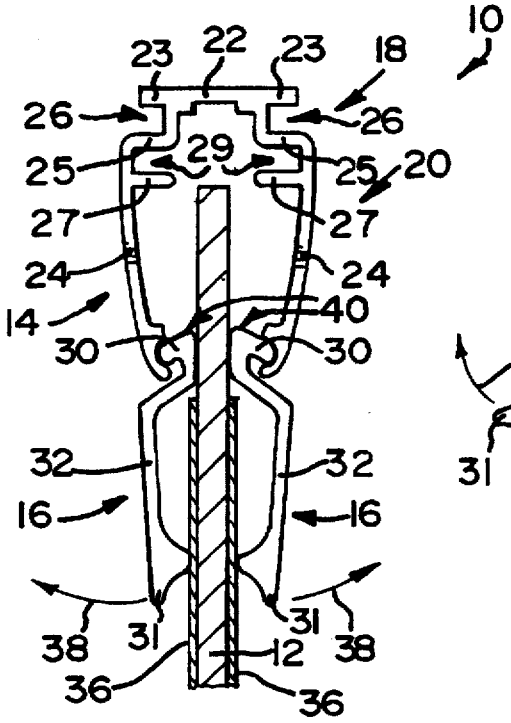
FIG. 1 shows, in part, a sectional elevation of a frame assembly which includes a frame member having an edge member and two clamp elements shown in their closed positions.
Figure 2:
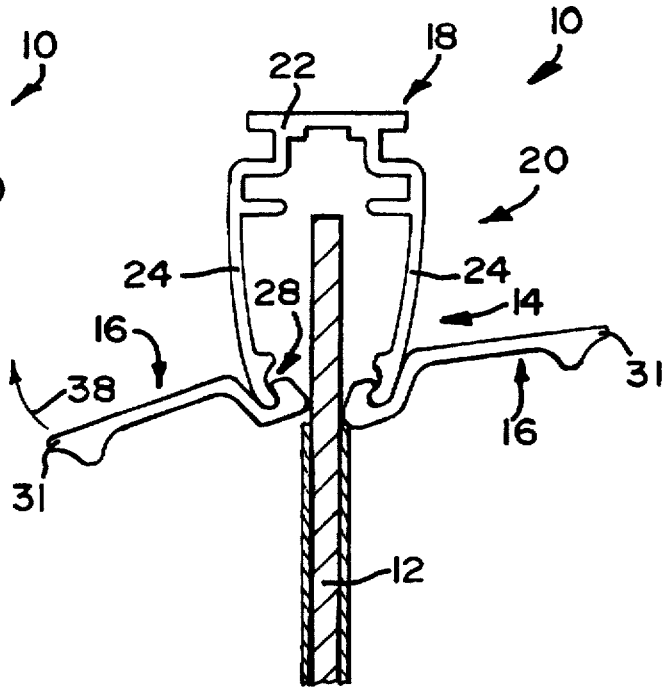
FIG. 2 shows a sectional view, similar to FIG. 1, with one of the clamp elements in a partially open position and the other clamp element in a fully open position.
Figure 9:
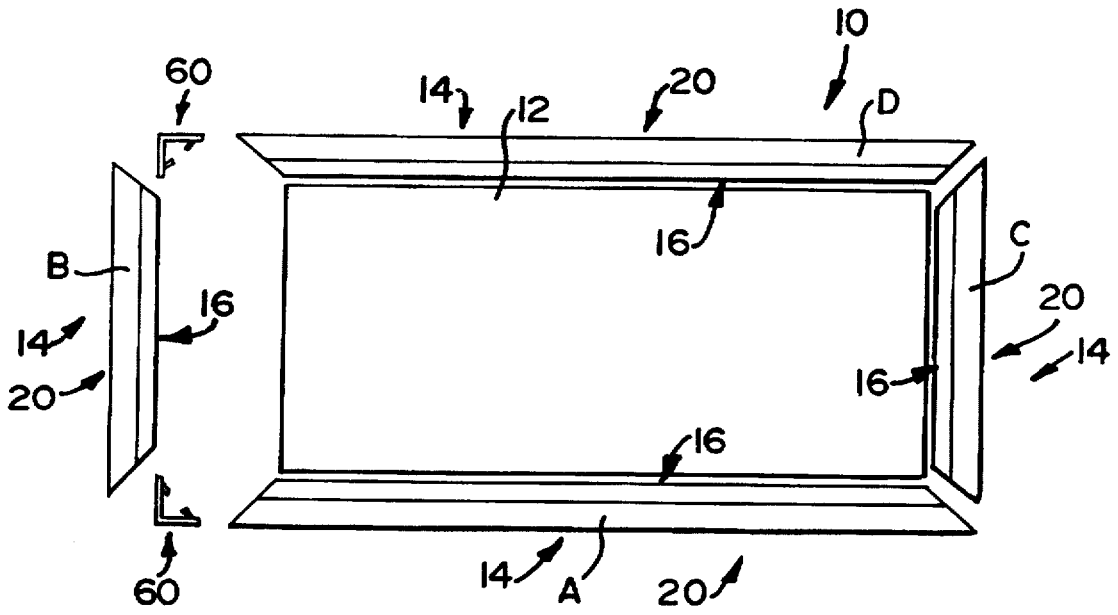
FIG. 9 shows a partly exploded view of the frame assembly shown, in part, in FIGS. 1 and 2.

In FIGS. 1, 2 and 9, of the drawings, reference numeral 10 refers generally to a frame assembly in accordance with the invention. The assembly 10 is shown in FIGS. 1 and 2 in part only.

The frame assembly 10 includes a backing member in the form of a board 12 which may be of any suitable material, e.g. hardboard, ABS, Corriboard or the like. The frame assembly 10 further includes a plurality of frame members 14 as can be seen, in particular, in FIG. 9.

Each frame member 14 includes a pair of clamp elements 16 and urging means, generally indicated by reference numeral 18, for urging the clamp elements 16 towards the board 12 as is described in more detail below.

The urging means 18 comprises an edge member 20 which is generally channel-shaped when viewed from an end thereof. The edge member 20 comprises an elongate base or web 22 and a pair of limbs 24 which protrude from the web 22 at transversely spaced apart positions. The limbs 24 are connected to the web 22 at positions spaced inwardly from the edges of the web 22 and are configured such that outwardly directed recesses or channel formations 26 are defined between the limbs 24 and the web 22. The recesses 26 have sides 23, 25, the sides 23 comprising parts of the web 22 and the sides 25 comprising extensions of the limbs 24. A pair of longitudinally extending ridges 27 protrude inwardly from the limbs 24 below the web 22 and define inwardly directed channels 29 with sides formed by the ridges 27 and the sides 25.

Figure 3:
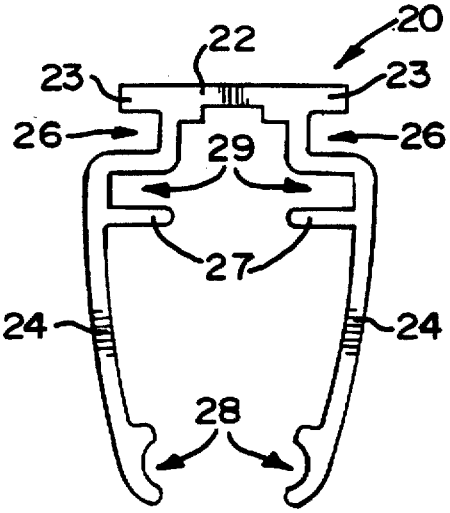
FIG. 3 shows an end view of the edge member of the frame assembly of FIGS. 1 and 2.

A longitudinally extending concave inwardly facing seat 28 (see FIG. 3) is formed into each limb 24 adjacent its free end. The spacing between the seats 28 is greater than the thickness of the board 12.

Figure 4:
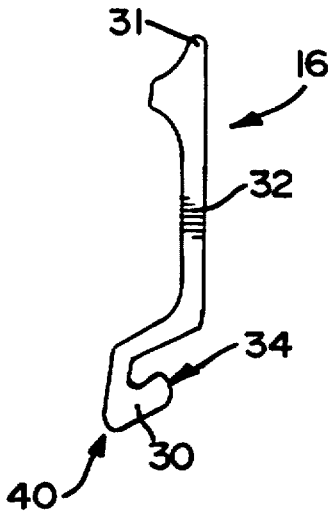
FIG. 4 shows an end view of one of the clamp elements of the frame assembly of FIGS. 1 and 2.

Referring now also to FIG. 4 of the drawings each clamp element 16 includes, at an edge portion thereof, a seat engaging formation 30 and a clamping formation 32 connected to the seat engaging formation 30. The seat engaging formation 30 defines a contact surface 34 which is complementary in shape to the shape of the seat 28 so as to permit pivotal displacement of the clamp elements 16 relative to the edge member 20. The clamping formation 32 and the seat engaging formation 30 intersect at an acute angle and together form a cam formation or arrangement 40 as described in more detail herebelow. The ends 31 of the clamping formations 32 function as gripping formations, or lips, for manually displacing the clamping formations 32.

Each edge member 20 and each clamp element 16 is extruded of aluminium, a synthetic plastics material or any other suitable material and hence each has a constant cross-section its entire length.

In use, as shown in FIGS. 1 and 2 of the drawings, the seat engaging formations 30 of the clamp elements 16 are positioned with the contact surfaces 34 in engagement with the seats 28 such that edge portions of the clamp elements 16 are positioned between the limbs 24 and the surfaces of the board 12. The various components of the frame assembly 10 are dimensioned such that the introduction of the seat engaging formations 30 between the limbs 24 and the board 12 cause the limbs 24 to be urged outwardly, or splayed, thereby inducing stress in the edge member 20 which in turn serves to urge the portions of the clamping elements 16 positioned between the limbs 24 and the board 12 inwardly towards the outer surfaces of the board 12. Hence, the seat engaging formations 30 are retained in position in engagement with the seats 28.

As mentioned above, the frame assembly 10 includes a plurality of frame members 14 arranged end-to-end around the periphery of the board 12 to form a frame as shown generally in FIG. 9. The ends of the frame members 14 are mitred, as can be seen in the drawing, to provide a neat appearance as is common in the manufacture of frames. For the purpose of FIGS. 9, 12 and 13, the frame members 14 of the assembly 10 have been indicated A (the horizontal lower or base member), B and C (the vertical side members) and D (the horizontal upper or top member).

Figure 10:
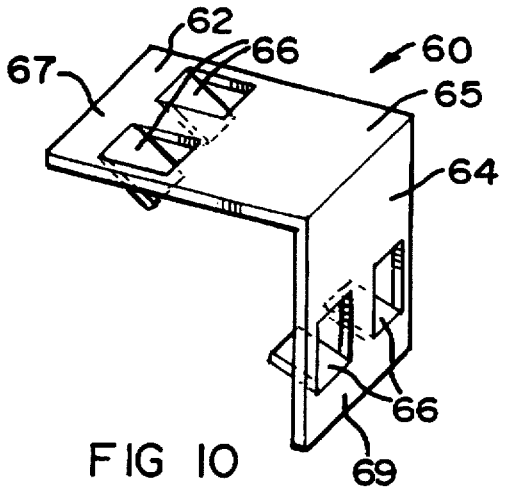
FIG. 10 shows a three-dimensional view of a fastener forming part of the frame assembly of FIGS. 1 and 2.
Figure 11:
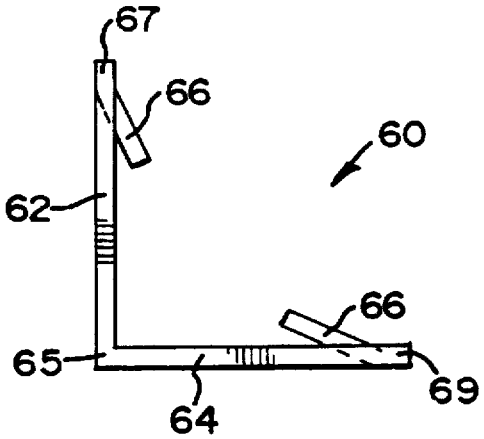
FIG. 11 shows an end view of the fastener of FIG. 10.

Referring now also to FIGS. 10 and 11, reference numeral 60 generally indicates a fastener for securing the edge members 20 of two adjacent frame members 14 together. The fastener 60 comprises an L-shaped bracket having limbs or legs 62, 64 arranged at right angles to one another with a common end 65 and respective leading ends 67, 69. Rectangular shaped retaining formations or protrusions 66 project from the legs 62, 64. Each protrusion 66 is produced by forming a pair of side-by-side generally U-shaped cuts in the legs 62, 64 near to their leading ends 67, 69 respectively and bending the portions between the cuts inwardly to form the protrusion 66, i.e. in the case of the leg 62, generally in the direction in which the leg 64 projects, and vice versa. Each protrusion 66 is thus inclined relative to the surface of its associated leg 62, 64 such that the extent to which it protrudes increases away from the free ends 67, 69 as can be seen, in particular, in FIG. 11.

Figure 5:
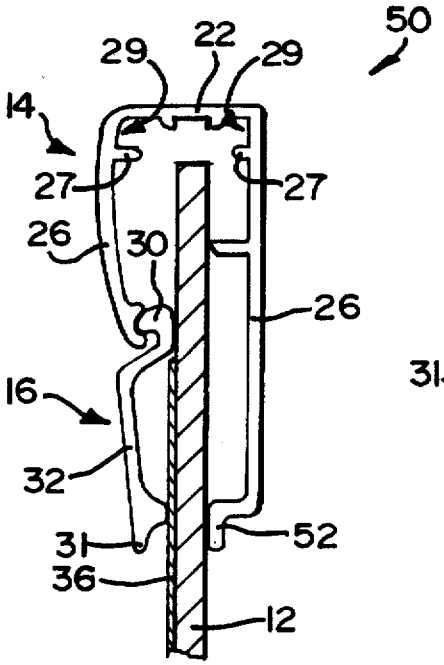
FIG. 5 shows a sectional view, similar to FIG. 1, of part of another frame assembly in accordance with the invention having a single clamp element which is shown in its closed position.
Figure 6:
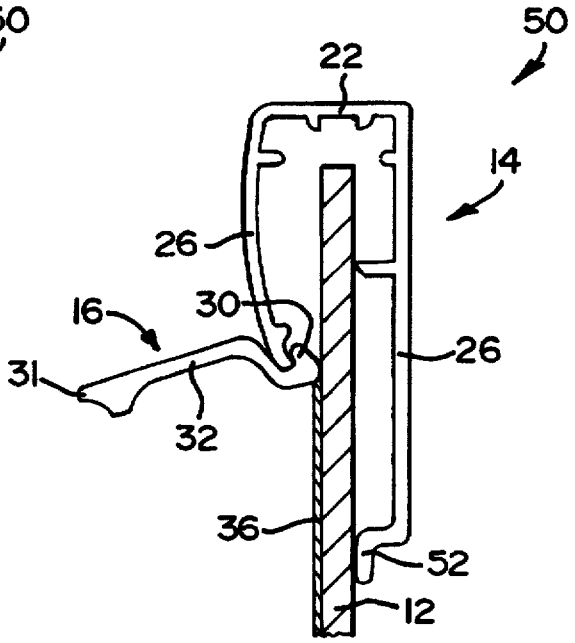
FIG. 6 shows a sectional view, similar to FIG. 5, with the clamp element in a partially open position.

The fasteners 60 are of tempered, galvanised, spring steel and the legs 62, 64 are each 27 mm long and 1.3 mm thick. The protrusions 66 are spaced 3 mm from the leading ends 67, 69 of the legs 62, 64 and are 7 mm long and are bent 3 mm inwardly. The legs 62, 64 are 13.4 mm wide for use with a single sided frame (as depicted in FIGS. 5 and 6) and 16.1 mm wide for use with a double sided frame (as depicted in FIGS. 1, 2 and 9). However, the dimensions may vary depending on the application.

Figure 13:
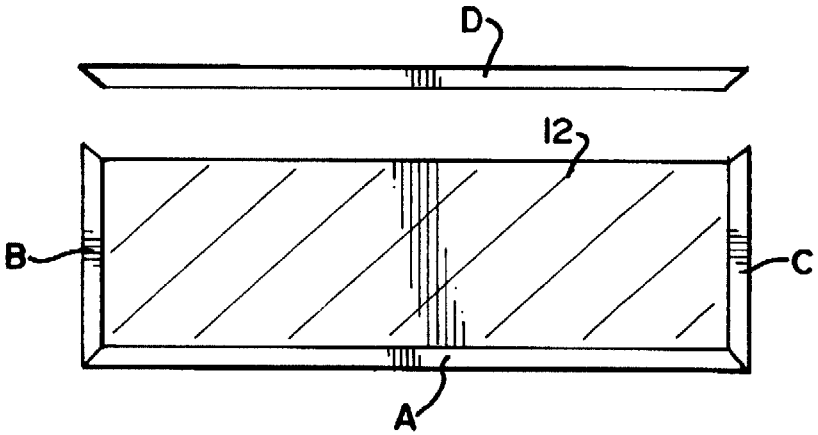
FIGS. 12 and 13 show two steps in the process of assembling the frame assembly depicted in FIG. 9.
Figure 12:
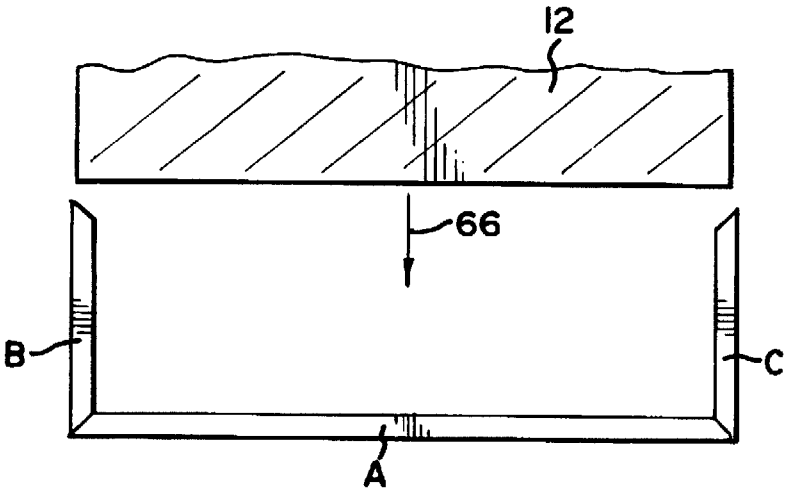

Referring to FIGS. 9, 12 and 13, in order to connect the frame members 14 together to form the frame assembly 10, the ends of the frame members 14 are cut at 45° angles, as shown in particular in FIG. 9. The legs 62 of two fasteners 60 are then inserted into the channels 29 (FIG. 1), which thus act as limb receiving zones, at opposite ends of the edge member 20 of the frame member A. The protrusions 66 are resiliently deformed thereby and they grippingly abut the ridges 27 (FIG. 1). The outer faces of the legs 62, 64 are, at the same time, urged into abutment with the sides 25 of the recesses 26 (FIG. 1) and the legs 62 are thereby frictionally held in place. The legs 64 are then inserted into the channels 29 of the edge members 20 of the frame members B and C and held in position in the same way to form the partly assembled frame 10 shown in FIG. 12. The board 12 is then slid in the direction of the arrow 66, with its edge portions received between the limbs 24. To accommodate the connectors 70, described in further detail below, the edge of the board 12 is spaced from the web 22, for example as shown in FIGS. 1 to 4. The board 12 is Corriboard with a thickness of 3.5 mm and has its grain directed at about 45° diagonally across the frame assembly 10 (as shown by the diagonal lines in FIGS. 12 and 13) to prevent it from deforming or breaking.

The edge member 20 of the top frame member D is then attached to the edge members 20 of the side members B and C in like fashion.

The seat engaging formations 30 of the clamp elements 16 are then positioned in the seats 28, thereby securing the clamp elements 16 between the edge members 20 and the board 12, to complete the frame assembly 10.

In order to position a poster 36 within the frame assembly 10, the clamp elements 16 are pivoted outwardly in the direction of the arrows 38 (FIGS. 1 and 2). The clamping formations 32 of the clamp elements 16 are configured such that their free ends 31, or lips, are spaced from the board 12 to permit gripping of the free ends 31 of the clamp elements 16 which are remote from the edge member 20 and displacing them in the direction of arrows 38.

As mentioned above, the seat engaging formation 30 and clamping formation 32 together define a cam arrangement, generally indicated by reference numeral 40 which is configured such that initially on the clamp element 16 being displaced from its closed position in the direction of arrow 38 the cam arrangement 40 causes an outward displacement or further splaying of the limbs 26 thereby increasing the stress in the frame member 14 and hence the force with which the clamp element 16 is urged towards its closed position. This splaying of the limbs 24 continues until the clamp element 16 reaches a partially open position illustrated by the clamp element on the left hand side of FIG. 2 at which the outward displacement of the limb is at a maximum. Further pivotal displacement of the clamp element 16 in the direction of arrow 38 permits the associated limb 24 to move inwardly thereby reducing the stress in the edge member 20 and hence the force applied by the limb 26 to the clamp element 16. Hence, the cam arrangement 40 is configured such that when the clamp element 16 is at any position between its closed position and the partially open position shown by the left hand clamp element in FIG. 2, the clamp element 16 is urged towards its closed position. However, displacement of the clamp element 16 beyond its partially open position results in the clamp element 16 being urged towards its fully open position shown by the right hand clamp element in FIG. 2. Hence, the cam arrangement 40 operates in the manner of an over-centre mechanism to maintain the clamp element 16 in its closed or fully open position as the case may be.

With all of the clamp elements 14 of the frame assembly 10 on one side of the board 12 in their fully open positions, the poster 36 or other art work can be positioned in abutment with the surface of the board 12. The clamp elements 16 are then displaced in a direction opposite to the direction of arrow 38 until they are in their closed positions in which edge portions of the poster 36 are clamped between the clamp elements 16 and the surface of the board 12. The clamp elements 14 and posters 36 are then mounted on the opposite side of the board 12 in the same fashion.

In order to remove the posters 36 the reverse procedure is followed. The ends 31 function as gripping formations which enable the clamp elements 16 readily to be gripped, for example by a finger tip, and displaced.

In the embodiment shown in FIGS. 1, 2, 9, 12 and 13 of the drawings, a poster 36 (not shown in FIGS. 9, 15 and 16) or other art work can thus be positioned on both sides of the board 12.

Further, use can be made of the channel formations 26 in order to hang the frame assembly 10.

Figure 7:
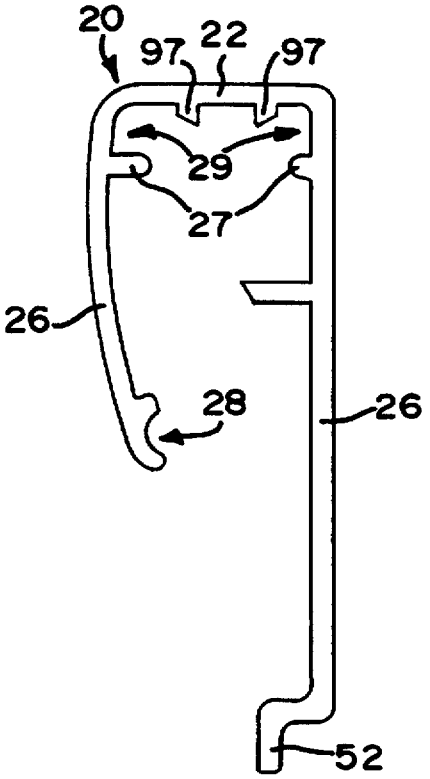
FIG. 7 shows, on an enlarged scale, an end view of the edge member of the frame assembly of FIGS. 5 and 6.

Reference is now made to FIGS. 5 and 6 of the drawings, in which reference numeral 50 refers generally to another frame assembly in accordance with the invention, also shown only in part in the drawings, and unless otherwise indicated, the same reference numerals used above are used to designate similar parts. In this embodiment of the invention, each frame member 14 includes a single clamp element 16 so that a poster 36 can be mounted on one side of the board 12 only. Hence, one of the limbs 26 of the edge member 20 is provided with a seat 28 (FIG. 7) which cooperates with the seat engaging formation 30 of the clamp element 16 in the manner described above. The other limb 26 is extended and has a board engaging lip 52 at its free end which is positioned to abut the opposite side of the board 12 to the clamp element 16. In this embodiment, the ridges 27 are positioned below the web 22 and together define with ribs 97 the limb receiving zone 29.

Figure 8:
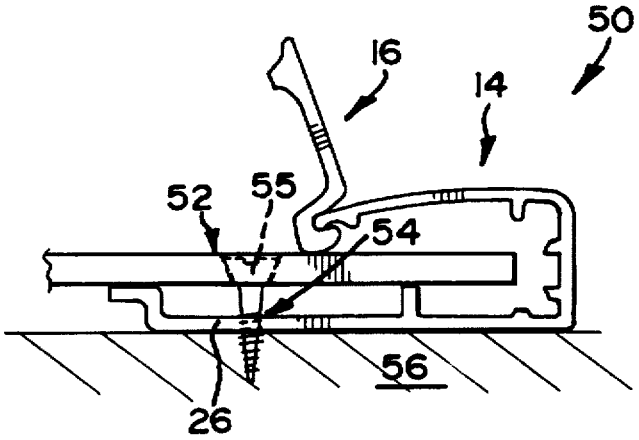
FIG. 8 shows, in part, the frame assembly of FIGS. 5 and 6 secured to a wall.

FIG. 8 shows, in part, the frame assembly 50 of FIGS. 5 and 6 secured to a wall 56. A hole 52 shaped to receive a countersunk screw 55 has been drilled through the board 12 and a second hole 54, in register with the hole 52, has been drilled through the limb 26 with the screw 55 extending through the holes 52, 54 and securing the frame assembly to the wall 56.

The frame assembly 50 is assembled using the connectors 60 exactly as for the assembly 10 described above, the legs 62, 64 being received and held in the limb receiving zones 29 of the edge members 14 as described above.

Figure 14:
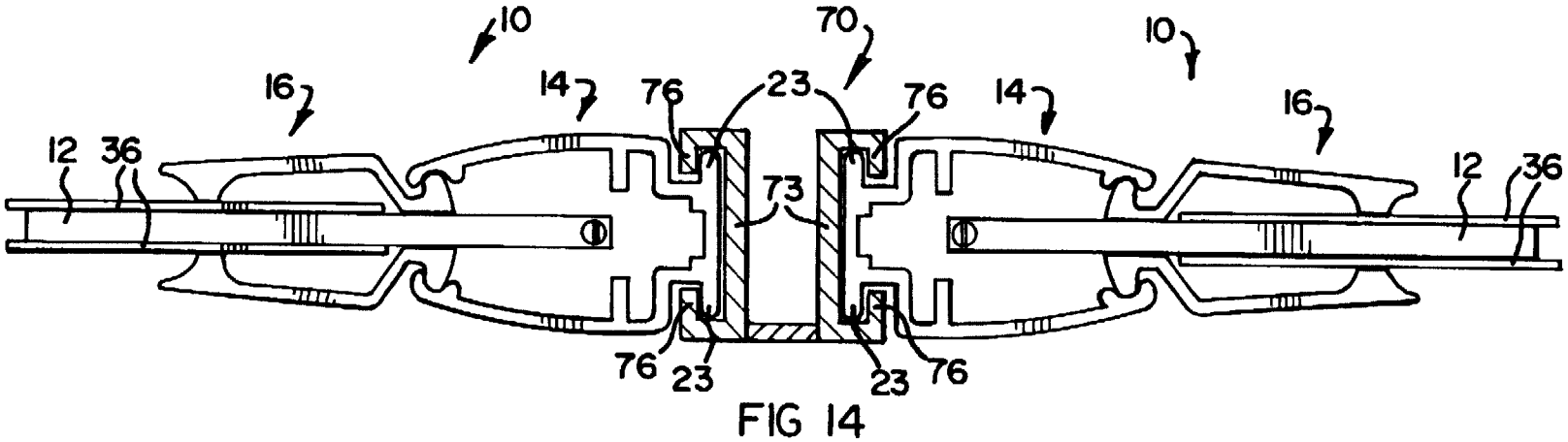
FIG. 14 shows, in part, a sectional end view of a display holder including a hinged connector and two of the frame assemblies of FIGS. 1 and 2.
Figure 15:
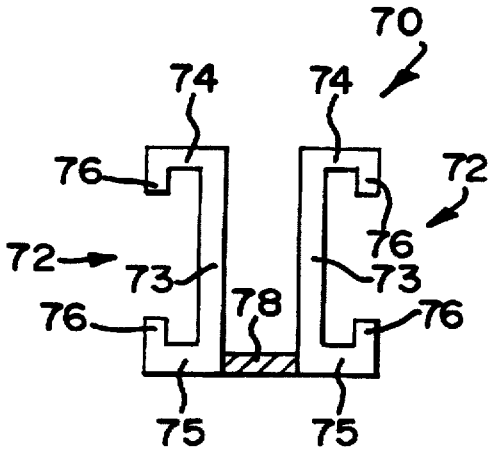
FIG. 15 shows a sectional end view of the hinged connector of FIG. 12.

Referring now to FIGS. 14 and 15, reference numeral 70 generally indicates a connector for connecting together two frame assemblies 10. The connector 70 comprises a pair of frame member engaging formations in the form of two elongate channel members 72 with bases 73 and sides 74, 75 having inwardly directed lips 76. The channel members 72 are connected back-to-back by a strip 78 of monoprene rubber. The strip 78 is positioned so that it forms a common extension of the complementary sides 75 of the channel members 72. The strip 78 permits the channel members 72 to be displaceable relative to one another. The channel members 72 are of extruded ultra-violet resistant polyvinyl chloride (UPVC). The bases 73 are 19 mm wide, the sides 74, 75 are 6.5 mm high, the strip 78 is 5.5 mm wide and the base 73 and walls 74, 75 are 2 mm thick. Once again, however, the dimensions may be varied to suit a particular application.

FIG. 14 shows, in part, two of the frame assemblies 10 connected by the connector 70 with the sides 23 of the outwardly directed channel formations 26 slidingly received between the bases 73 and the lips 76 of the channel members 72. The frame assemblies 10 are thus connected together and hingedly displaceable relative to each other.

Figure 16:
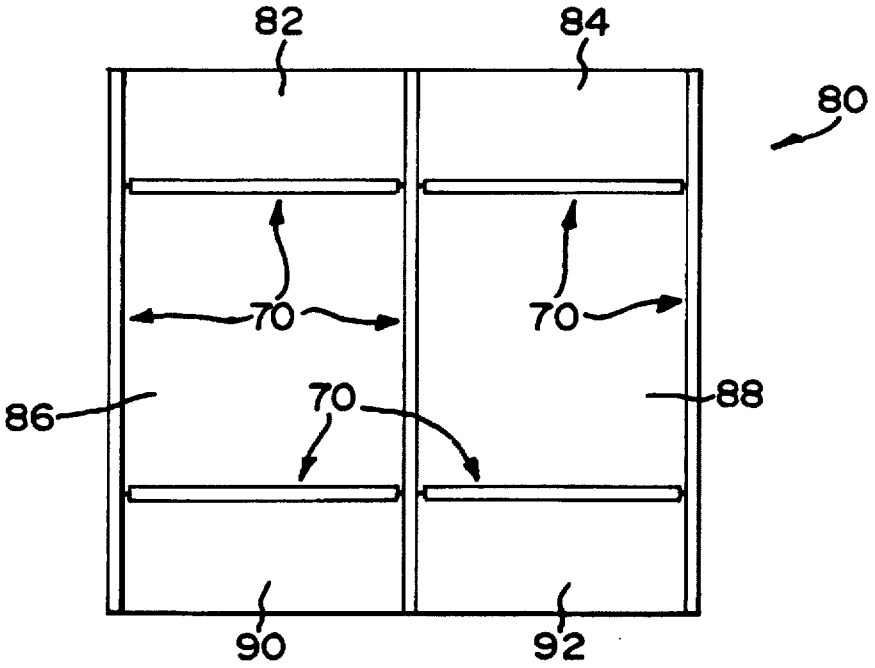
FIG. 16 shows a front view of the display holder shown, in part, in FIG. 14.

FIG. 16 shows a display holder 80 comprising six frame assemblies connected together by five connectors 70. Each frame assembly resembles the assembly 10. In particular, the display holder 80 includes left and right upper frame assemblies or headers 82, 84, left and right middle frame assemblies or main posters 86, 88, and left and right lower frame assemblies or footer boards 90, 92. The headers 82, 84 and footer boards 90, 92 are connected to the main posters 86, 88 by shorter horizontal connectors 70 and the left header 82, main poster 86 and footer board 90 are connected to the right header 84, right main poster 88 and right footer board 92 by a longer vertical connector 70. Further longer vertical connectors 70 extend along the outer edges of the display holder 80 for engagement with further frame assemblies 10.

The frame assemblies and/or display holders may be supplied in assembled form or in kit form with the kit including some or all of the components required to form the frame assembly and/or display holder.

The Applicant believes that, in view of the fact that the components of the frame assembly 10 are extruded, they will be producible at a cost which is at least comparable with the cost of the components of other frame assemblies of which the Applicant is aware. In addition, in view of the ease with which a poster 36 or the like can be mounted on the board 12 and removed therefrom and, in particular, in view of the ease with which the ends 31 or lips of the clamping formations 32 can be manually gripped to displace the clamping formations 32, the Applicant believes that the frame assembly 10, 50 will be relatively simple and convenient to use. In addition, because no separate springs are required, the Applicant believes that the frame assembly 10, 50 will be reliable and have a relatively long life. The Applicant also believes that it is an advantage of the invention illustrated that the fasteners 60 will allow a frame assembly 10, 50 to be relatively easily and quickly assembled and that the connectors 70 will similarly allow a display holder 80 of desired configuration to be relatively easily assembled from a number of the frame assemblies 10.

I claim:

1. A frame assembly which includes a backing board; and a plurality of elongate frame members positioned end-to-end around at least part of the periphery of the backing board each frame member including:

an edge member having a pair of limbs positioned on opposite sides of an edge portion of the backing board; and at least two clamp elements which are positioned between the limbs of the associated edge member and opposite sides of the backing board, each clamp element having a first edge portion which is an interference fit between a complementary edge portion of one of the limbs of the edge member and the backing board so that it urges the limbs of the edge member apart to induce a stress in the edge member which in turn urges the clamp element towards the backing board, the first edge portion of the clamp element and the complementary edge portion of the edge member defining complementary retaining formations which serve to retain the first edge portion of the clamp element captive between the complementary edge portion of the edge member and the backing board and which permit displacement of the clamp element between a closed position in which an edge portion of a sheet can be clamped between the clamp element and the backing board, and an open position in which an edge portion of a said sheet can be positioned or removed from between the clamp clement and the backing board, at least one clamp element having at least one gripping formation spaced from its first edge portion and configured to facilitate displacement of the clamp element from its closed position towards its open position, the gripping formation being in the form of a lip at that edge of the clamp element remote from the edge member, the lip being clear of the backing board even when the clamp element is in its closed position.

2. A frame assembly as claimed in claim 1, which includes a fastener connecting each pair of adjacent edge members together, the fastener having a pair of elongate limbs connected together at their one ends, the limbs of said fastener being located in the edge members of adjacent frame members to retain the adjacent frame members in position relative to one another, the fastener and the adjacent edge members having complementary retaining formations for retaining the limbs of the fastener in position in the edge members.

3. A frame assembly as claimed in claim 2, in which the retaining formations of each edge member define a limb receiving zone within which the limb of the associated fastener is snugly received, the complementary retaining formation of the associated fastener including at least one protrusion standing proud of the limb and abutting a surface of the edge member defining the limb receiving zone, each protrusion being inclined relative to the surface of the associated limb such that the extent to which it protrudes increases away from the free end of the limb thereby facilitating the introduction of the limb into the limb receiving zone and resisting withdrawal of the limb from the limb receiving zone.

4. A display holder which includes at least two frame assemblies at least one of which is a frame assembly as claimed in claim 1; and connecting means whereby the frame assemblies are connected together.

5. A display holder as claimed in claim 4, in which the connecting means includes a connector connected to and extending between frame members of the at least two frame assemblies to connect together the at least two frame assemblies, the connector including a pair of frame member engaging formations which are connected together and the frame members of the at least two frame assemblies including complementary engagement formations, the frame member engaging formations of the connector being engaged with the complementary engagement formations of the frame members.

6. A display holder as claimed in claim 5, in which each complementary engagement formation of the frame members includes a pair of oppositely disposed outwardly open longitudinally extending recesses and each frame member engaging formation includes a pair of oppositely inwardly disposed lips which are slidably receivable in the recesses.

7. A frame assembly which includes:

a backing board; and a plurality of elongate frame members positioned end-to-end around at least part of the periphery of the backing board each frame member including:

an edge member having a pair of limbs positioned on opposite sides of an edge portion of the backing board; and at least one clamp element having a first edge portion which is an interference fit between a complementary edge portion of one of the limbs of the edge member and the backing board so that it urges the limbs of the edge member apart to induce a stress in the edge member which in turn urges the clamp element towards the backing board, the first edge portion of the clamp element and the complementary edge portion of the edge member defining complementary retaining formations which serve to retain the first edge portion of the clamp element captive between the complementary edge portion of the edge member and the backing board and which permit displacement of the clamp element between a closed position in which an edge portion of a sheet can be clamped between the clamp element and the backing board, and an open position in which an edge portion of a said sheet can be positioned or removed from between the clamp element and the backing board the complementary retaining formations of the clamp element and edge member together defining a cam arrangement configured such that displacement of the clamp element from its closed position to its open position or vice versa, initially urges the limbs of the edge member further apart and then permits the spacing between the limbs to decrease so that the cam arrangement operates in the manner of an over-centre mechanism, the clamp element having at least one gripping formation spaced from its first edge portion and configured to facilitate displacement of the clamp element from its closed position towards its open position, at least one of the edge members and clamp elements being formed as extrusions.

8. A frame assembly as claimed in claim 7, which includes a fastener connecting each pair of adjacent edge members together, the fastener having a pair of elongate limbs connected together at their one ends, the limbs of said fastener being located in the edge members of adjacent frame members to retain the adjacent frame members in position relative to one another, the fastener and the adjacent edge members having complementary retaining structures for retaining the limbs of the fastener in position in the edge members.

9. A frame assembly as claimed in claim 8, in which the retaining structures of each edge member define a limb receiving zone within which the limb of the associated fastener is snugly received, the complementary retaining structures of the associated fastener including at least one protrusion standing proud of the limb of the fastener and abutting a surface of the edge member defining the limb receiving zone, each protrusion being inclined relative to the surface of the associated limb of the fastener such that the extent to which it protrudes increases away from a free end of the limb thereby facilitating the introduction of the limb of the fastener into the limb receiving zone and resisting withdrawal of the limb of the fastener from the limb receiving zone.

10. A display holder which includes:

at least two frame assemblies, at least one of which is a frame assembly as claimed in claim 7; and connecting means whereby the frame assemblies are connected together.

11. A display holder as claimed in claim 10, in which the connecting means includes a connector connected to and extending between frame members of the at least two frame assemblies to connect together the at least two frame assemblies, the connector including a pair of frame member engaging formations which are connected together and the frame members of the at least two frame assemblies including complementary engagement formations, the frame member engaging formations of the connector being engaged with the complementary engagement formations of the frame members.

12. A display holder as claimed in claim 11, in which the frame member engaging formations are connected together by means of a bridging-piece configured to permit displacement of the frame member engaging formation relative to one another.

13. A display holder as claimed in claim 12, in which the bridging-piece is in the form of a strip of an elastomeric material.

14. A display holder as claimed in claim 11, in which each complementary engagement formation of the frame members includes a pair of oppositely disposed outwardly open longitudinally extending recesses and each frame member engaging formation includes a pair of oppositely inwardly disposed lips which are slidably receivable in the recesses.

* * * * *